US005482250A

United States Patent [19]

Kodaira

[11] Patent Number: 5,482,250

[45] Date of Patent: Jan. 9, 1996

[54] AUTOMATIC FLUSHING DEVICE

[75] Inventor: Makoto Kodaira, Shinagawa, Japan

[73] Assignee: Uro Denshi Kogyo Kabushiki Kaisha, Tokyo, Japan

[21] Appl. No.: 312,148

[22] Filed: Sep. 26, 1994

[30] Foreign Application Priority Data

Oct. 14, 1993 [JP] Japan ..... 5-55623 U

[51] Int. Cl.[6] ..... E03D 5/10

[52] U.S. Cl. ..... 251/129.04; 4/304; 4/623

[58] Field of Search ..... 251/129.04; 4/623, 4/304, 305, DIG. 3, 313; 137/624.11

[56] References Cited

U.S. PATENT DOCUMENTS

| | | | |
|---|---|---|---|
| 4,624,017 | 11/1986 | Foletta | 4/623 X |
| 5,063,955 | 11/1991 | Sakakibara | 251/129.04 X |
| 5,187,816 | 2/1993 | Chiou | 4/304 X |
| 5,224,685 | 7/1993 | Chiang et al. | 251/129.04 |

*Primary Examiner*—Martin P. Schwadron

*Assistant Examiner*—Kevin L. Lee

*Attorney, Agent, or Firm*—Ladas & Parry

[57] ABSTRACT

There is provided a device attached to the flush valve of an existing stool and adapted for automatically carrying out flushing. This automatic flushing device comprises: a first sensor section for detecting approach and withdrawal of the human body; a second sensor section having a predetermined sensing range and operative to output a detection signal when a portion of the human body exists within the sensing range; a signal processing circuit operative to output a drive signal when the first sensor section detects withdrawal of the human body after more than a predetermined time is passed from the time point when the first sensor section detects approach of the human body, or when the second sensor section outputs the detection signal; an electromagnetic valve mechanism for opening an electromagnetic valve when the drive signal is outputted from the signal processing circuit; and attachment means adapted for accommodating the first and second sensor sections, the signal processing circuit and the electromagnetic valve mechanism, and for attaching them to an existing flush valve.

2 Claims, 7 Drawing Sheets

AUTOMATIC FLUSHING DEVICE

BACKGROUND OF THE INVENTION

This invention relates to an automatic flushing device, and more particularly to a device attached to the flush valve of existing water closets and adapted for automatically carrying out flushing.

Hitherto, devices for automatically flushing water closets needed to be replaced by new ones every flush valve. There was no cleaning device which could be easily attached to the existing flush valves.

Further, conventional automatic flushing devices are adapted to detect by means of a sensor that a user stands up after sitting on the stool cover to carry out flushing. Accordingly, also in the case where the user wants to flush the toilet during use while sitting on the stool cover, he must once stand up. This was inconvenient. If there is employed a system of flushing by means of a push-button in place of a system of automatically detecting the user's attitude relative to the stool cover by means of a sensor, there was the problem that it is difficult for the user to depress such push-button during use in the case where the push-button is positioned behind the user. Moreover, even if the push-button is provided at a position easy to depress, the user must directly come into contact with the push-button. This is unsanitary. Further, in the case where a sensor of the remote control type is provided at a position allowing easy operation by the user in a non-contact manner, some sort of device for transmitting/receiving a signal between the sensor and automatic flushing device is required, disadvantageously resulting in high cost. In addition, power must be continuously supplied to the sensor side and the receiving side so that there results the state capable of detecting a user, resulting in the problem that current consumption is increased.

As stated above, there were the problems that conventional devices cannot be easily attached to an existing flush valve, and it is difficult to carry out flushing during use.

SUMMARY OF THE INVENTION

Accordingly, an object of this invention is to provide an automatic flushing device which can be easily attached to an existing flush valve, and which can easily carry out flushing even during use.

To achieve the above-mentioned object, in accordance with this invention, there is provided an automatic flushing device comprising: a first sensor section for detecting approach and withdrawal of the human body; a second sensor section having a predetermined sensing range and operating to output a detection signal when a portion of a human body exists in the sensing range; a signal processing circuit operating to output a drive signal when withdrawal of a human body is detected after more than a predetermined time has passed from the time point when the first sensor section detects approach of the human body, or when the second sensor section outputs the detection signal; an electromagnetic valve mechanism for opening an electromagnetic valve when the drive signal is outputted from the signal processing circuit; and attachment means adapted for accommodating the first and second sensor sections, the signal processing circuit and the electromagnetic valve mechanism and for attaching them to the existing flush valve.

In operation, when withdrawal of a human body is detected after more than a predetermined time has passed from the time point when the first sensor section detects approach of a human body, the signal processing circuit determines that the user has finished and outputs a drive signal. As a result, the electromagnetic valve is opened. Thus, flushing is carried out. Further, also when a portion of a human body exists in the sensing range of the second sensor section, the signal processing circuit outputs a drive signal. As a result, the electromagnetic valve is opened. Thus, flushing is carried out. As stated above, even during use where withdrawal of a human body is not detected, a portion of a human body is caused to fall within the sensing range of the second sensor section, thereby making it possible to carry out flushing. In addition, the attachment means for accommodating the first and second sensor sections, signal processing circuit and electromagnetic valve mechanism is attached to the existing flush valve, thereby making it possible to easily carry out automatic flushing.

DESCRIPTION OF THE PREFERRED EMBODIMENTS

Preferred embodiments of this invention will now be described with reference to the attached drawings. The automatic flushing devices according to the embodiments are adapted to automatically open and close an electromagnetic valve by means of a sensor to control flushing. After the handle unit of the existing flush valve is detached, those automatic flushing devices can be attached with ease.

Figure 1:
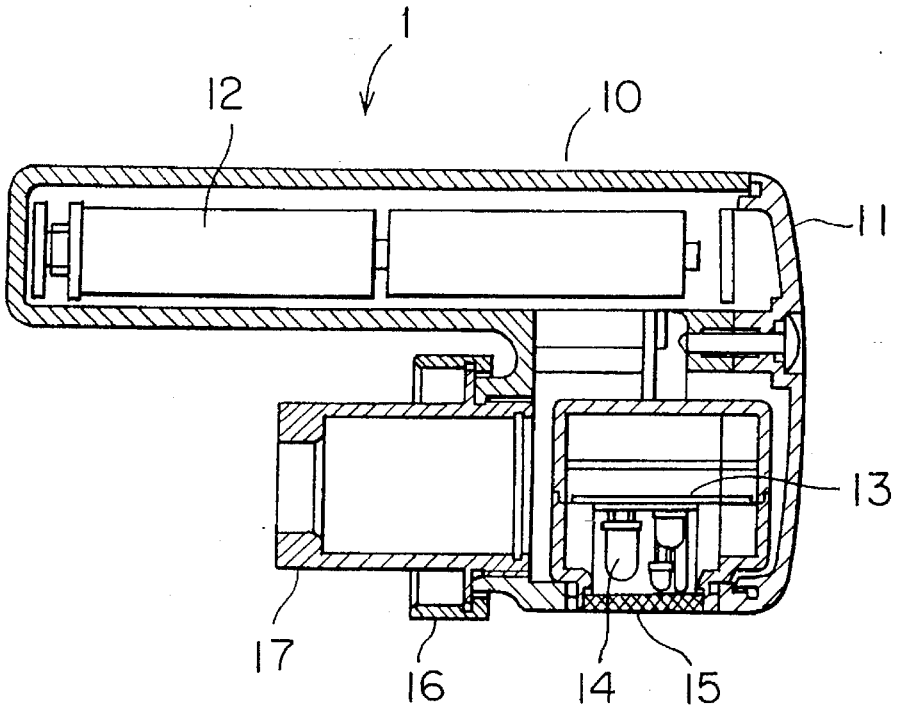
FIG. 1 is a cross sectional top view showing the configuration of an automatic flushing device according to a first embodiment of this invention.
Figure 2:
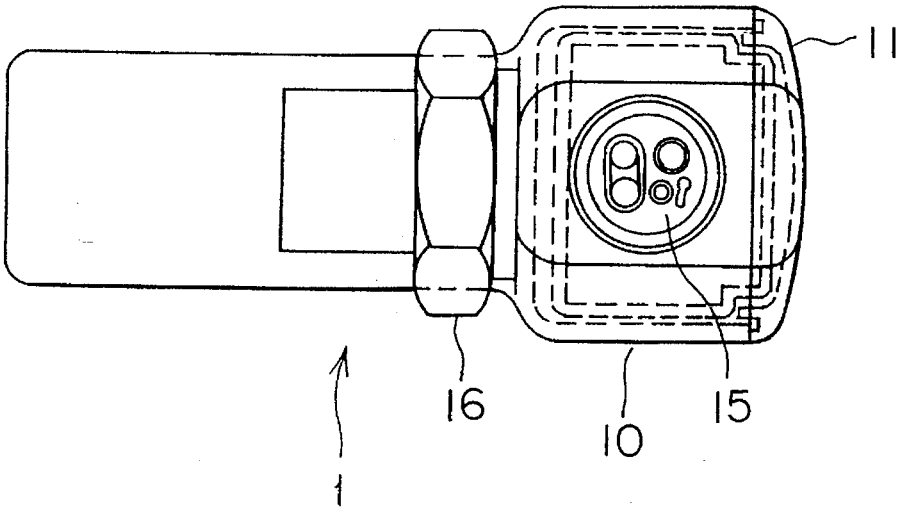
FIG. 2 is a front view of FIG. 1 showing appearance of the automatic flushing device.

The cross sectional configuration of an automatic flushing device 1 according to the first embodiment is shown in FIG. 1, and the front view of FIG. 1 is shown in FIG. 2.

Case 10 is in the form of a U-shape. Within case 10 and cover (cap) 11, a sensor section 14, a signal processing circuit 13, and a battery 12 are accommodated.

The sensor section 14 serves to detect that user sits on the stool cover then stands up. Namely, the sensor section 14 detects that the human body exists until a predetermined time has passed after the human body becomes closer thereto, and is then away therefrom.

In a more practical sense, there may be employed, e.g., a sensor to radiate infrared rays from an infrared light emitting diode (LED) or a pyroelectric sensor to detect heat radiated from the human body. It is to be noted that the surface of the portion for carrying out detection by means of sensor section 14 is covered by a sensor cover 15.

The signal processing circuit 13 is supplied with a detection signal outputted from sensor section 14 to carry out necessary processing for judging timing at which flushing is to be carried out, etc. to deliver a current to the solenoid which will be described later.

Further, a battery 12 is used as the power supply in this embodiment. This is because handling at an existing lavatory provided with no commercial power supply available around the flush valve is generally taken into consideration. Exchange of the battery 12 can be easily carried out with cover 11 being detached from case 10.

Figure 3:
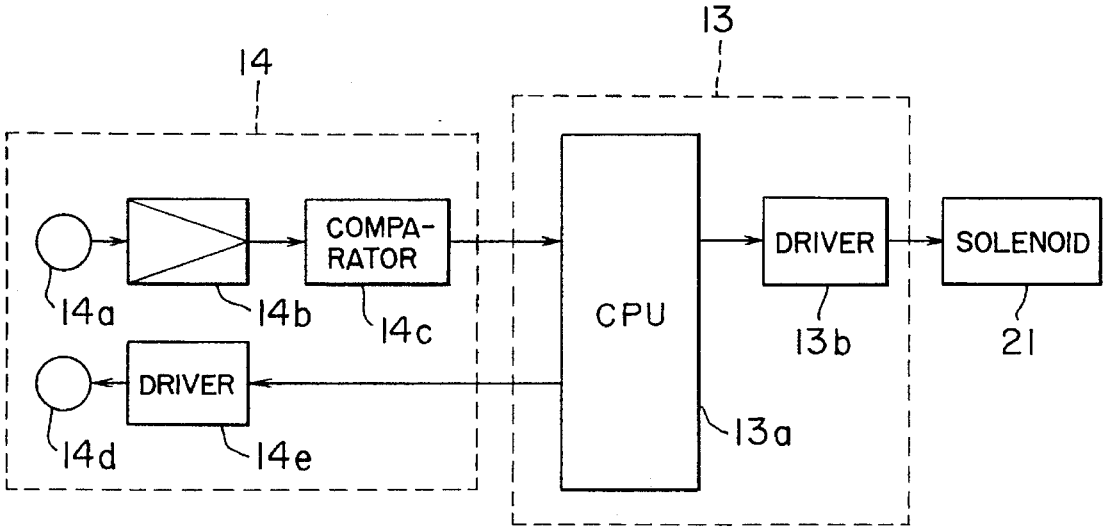
FIG. 3 is a block diagram showing the circuit configuration of the sensor section, signal processing circuit and solenoid in the automatic flushing device.

The circuit configuration of the sensor section 14, signal processing circuit 13 and solenoid 21 in this embodiment is shown in FIG. 3. In this figure, power supply lines for delivering power to the respective elements are omitted. The sensor section 14 includes, as elements for emitting infrared rays, a driver 14*e* and an infrared light emitting diode (LED) 14*d*, and includes, as elements for receiving infrared rays reflected by the human body, a photo transistor 14*a*, an amplifier 14*b* and a comparator 14*c*.

The signal processing circuit 13 includes a CPU 13*a* and a driver 13*b*.

The driver 14*e* becomes operative in response to a control signal delivered from CPU 13*a*. As a result, a drive current is delivered to infrared light emitting diode (LED) 14*d*, from which infrared rays are outputted. When these infrared rays are reflected by the human body, etc., the reflected light is received by photo-transistor 14*a*. A signal amplified at amplifier 14*b* is compared with a reference value at comparator 14*c*. As a result, in the case where that signal is above the reference value, a detection signal is outputted to CPU 13*a*.

The detection signal outputted from comparator 14*c* is inputted to CPU 13*a* of signal processing circuit 13. When the user sits in front of the stool for more than the predetermined time, the detection signal is continuously inputted to CPU 13*a* during that time period. Thereafter, when the user stands up from the stool, so no detection signal is inputted, and a control signal is outputted from CPU 13*a* to driver 13*b*. Thus, current is delivered from driver 13*b* to solenoid 21, so the electromagnetic valve is operated and opened.

The automatic cleaning device 1 according to this embodiment includes a spring, rod and rod supporting member as the electromagnetic valve mechanism except for solenoid 21 in addition to the elements shown in FIGS. 1 to 3, and further includes a valve connecting member and cap nuts as members for connection to an existing flush valve.

Figure 4:
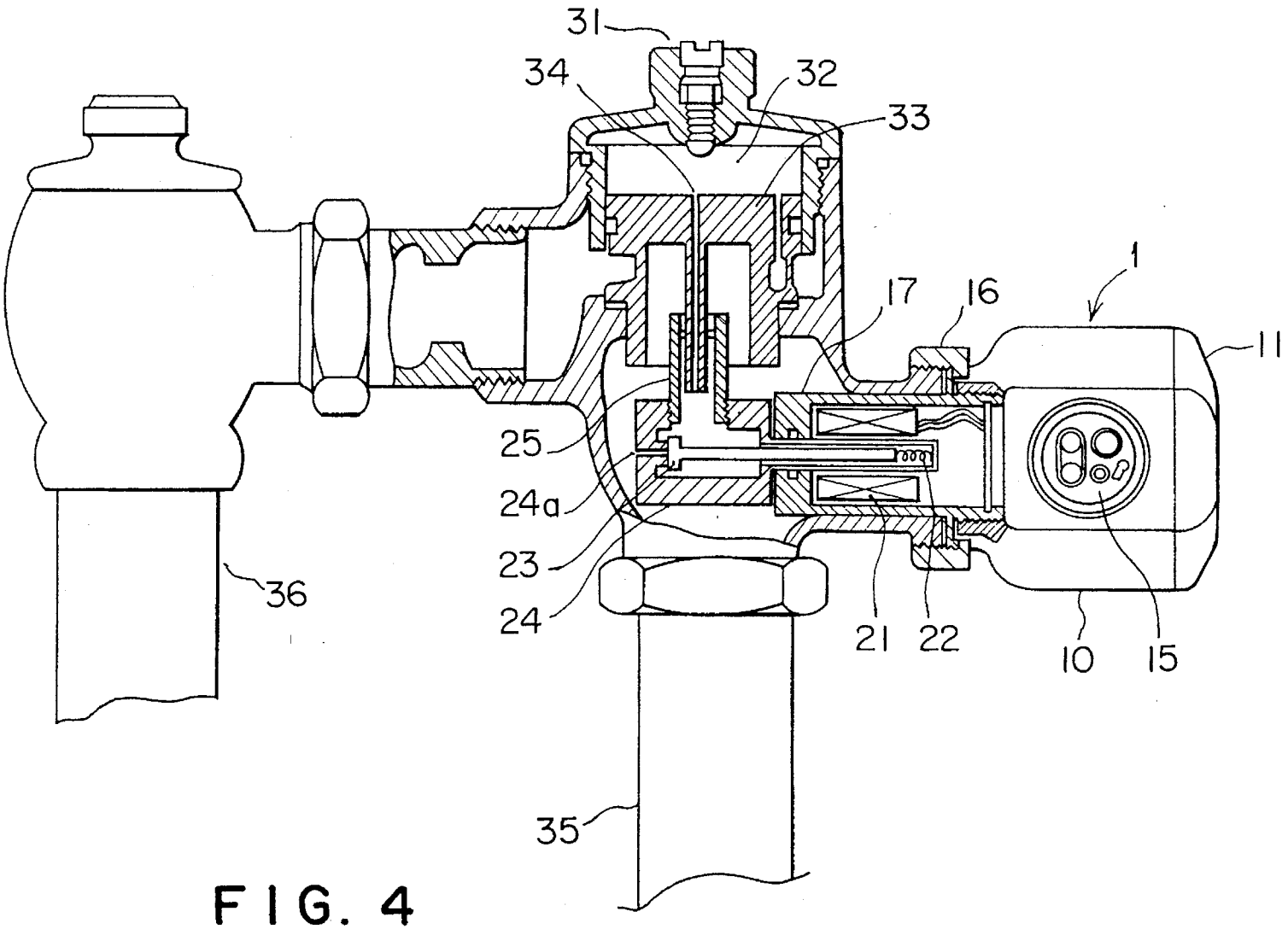
FIG. 4 is a longitudinal cross sectional section showing the state where the automatic flushing device is attached to an existing flush valve.
Figure 5:
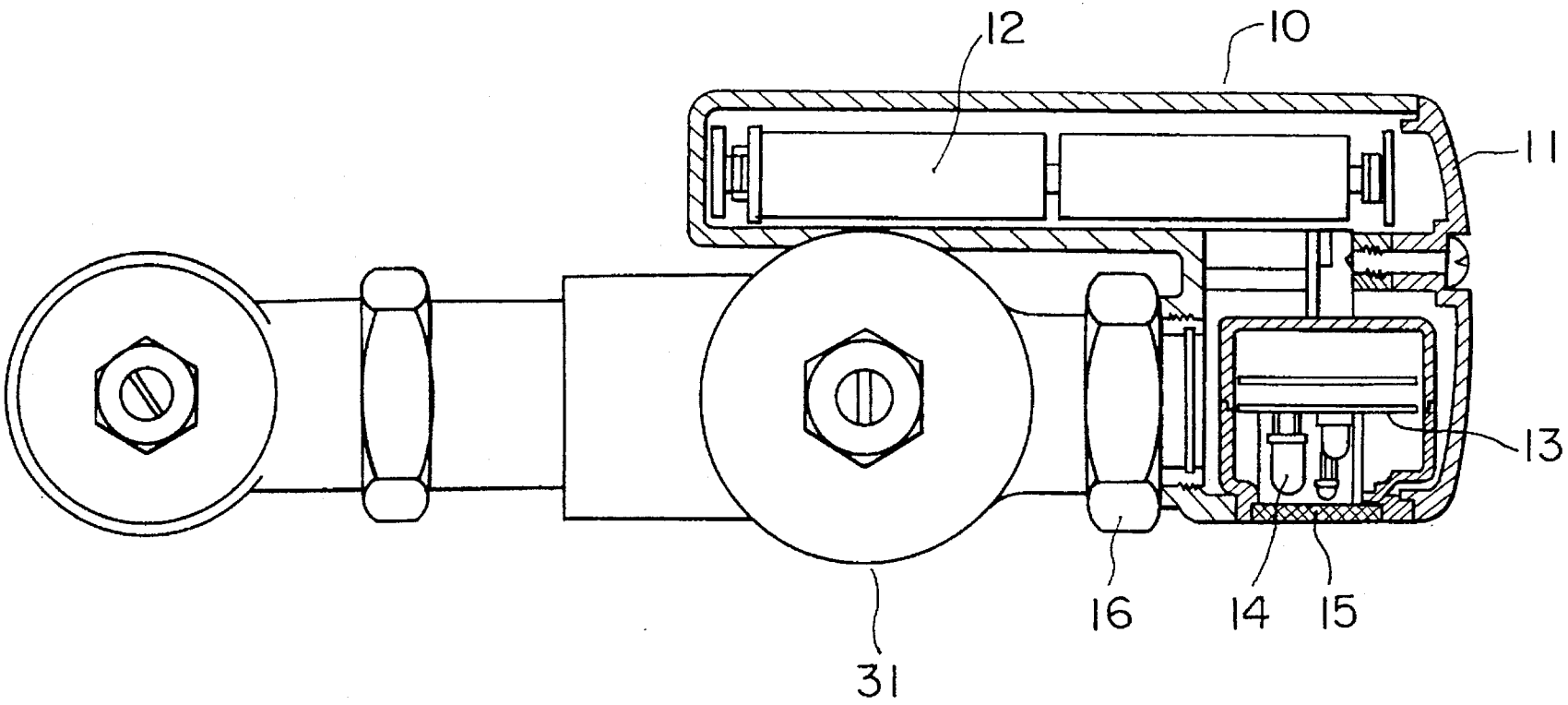
FIG. 5 is a cross sectional top view of FIG. 4 showing appearance when the automatic flushing device is attached to an existing flush valve.

The state where the automatic flushing device 1 according to this embodiment is attached to an existing flush valve is shown in FIG. 4. The plan view of FIG. 4 is shown in FIG. 5. At the operation section of the existing flush valve 31, there is provided a handle unit including a handle that the user operates, a valve rod adapted so that it is pushed when the handle is operated to open the valve, and cap nuts for fixing the handle unit on the flush valve.

This handle unit is detached and automatic flushing device 1 is attached to flush valve 31 by means of cap nuts 16. At the front end of connecting portion 17 of case 10, a rod supporting member 24 and a valve connecting member 25 are attached. This valve connecting member 25 is tubular, and is hermetically fitted to piston valve 33 in slidable state. The rod supporting member 24 is hollow and provided at one end with a penetration hole 24*a*, and includes therewithin a compression spring 22 and a magnetic rod 23. Within the connecting portion 17, tubular solenoid 21 is provided. This solenoid 21 surrounds the periphery of the front end portion of rod supporting member 24. Construction work for attaching device 1 of this embodiment to the existing flush valve is easy, and can be carried out in a short time.

As described above, when use is detected, a current flows in solenoid 21. As a result, the rod 23 biased by compression spring 22 slides in a right direction in FIG. 4. When rod 23 slides in the right direction, a clearance is formed between the penetration hole 24*a* of the rod supporting member 24 and the rod 23. Thus, water existing within small chamber 32 flows into connection tube 35 through small hole 34 of piston valve 33, inside portion of valve connection member 25, and small hole 24*a* of rod supporting member 24. When water within small chamber 32 flows out, water pressure at this portion is lowered. Thus, piston valve 33 slides in an upper direction of the figure. As a result, water of main current flows from water line 35 into connection tube 35.

When cleaning water flows out for a predetermined time, supply of current to solenoid 21 is stopped by control of CPU 13*a* of signal processing circuit 13. Thus, rod 23 is biased in a left direction of the figure by compression spring 22. As a result, small hole 24*a* of rod supporting member 24 is closed, so water within small chamber 32 does not flow in a lower direction, and water pressure is thus kept constant. Thus, piston valve 33 slides in a lower direction, so the portion between water pipe 36 and connection tube 35 is closed. Thus, supply of cleaning water is stopped.

Timing for carrying out flushing may be selected from timings described below.

Initially, cleaning may be carried out only after use as described above. Namely, in the case where it is detected that the user has withdrawn after, e.g., more than 8 seconds elapse from the time point when sensor section 14 detects approach of the user, post-cleaning is carried out.

Alternatively, pre-cleaning and post-cleaning may be combined. In the case where withdrawal of the user is not detected until, e.g., more than two seconds after approach of user is detected, pre-cleaning is carried out. When withdrawal is detected after, e.g., 8 seconds elapse after approach of the user is detected, post-cleaning is carried out. As stated above, by placing the wall surface of the stool in a wet state by pre-cleaning, post-cleaning is facilitated.

In accordance with the above-described first embodiment, the automatic flushing device can be easily attached to the existing flush valve by construction work of short time. In addition, a battery is used as the power supply. Handling at an existing stool is easy because a battery is used as power supply. By removing cover 11, the automatic flushing device can be easily exchanged.

Figure 6:
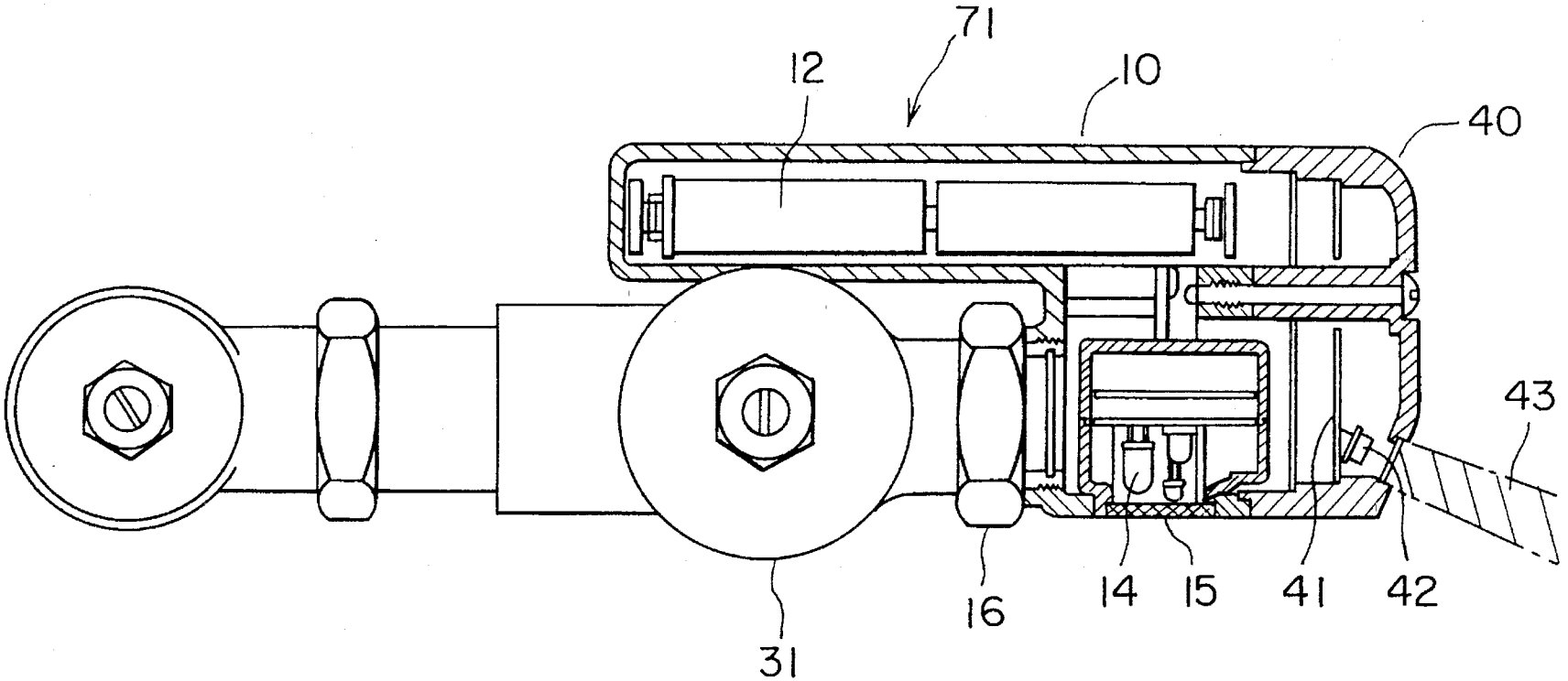
FIG. 6 is a longitudinal cross section showing the configuration of an automatic flushing device according to a second embodiment of this invention.

An automatic flushing device according to the second embodiment of this invention will now be described. The configuration of the automatic flushing device 71 according to this embodiment is shown in FIG. 6. In this embodiment, in order to permit a user to also flush during use, in addition to the elements of the first embodiment, the device further includes a second sensor section 42 and a signal processing circuit 41 for processing a detection signal outputted from the second sensor section 42. The second sensor section 42 and the signal processing circuit 41 are accommodated within cover 40. Accordingly, cover 11 of the device according to the first embodiment is replaced by cover 40 of the second embodiment to carry out necessary connection by using connector, etc., thereby making it possible to modify it into the device of the second embodiment. Further, also in the case where second sensor section 42 or signal processing circuit 41 becomes faulty, the faulty portion can be easily exchanged by only exchanging cover 40. In addition, sensing range 43 of second sensor section 42 is set in a lateral direction or in an oblique and lateral direction.

Figure 7:
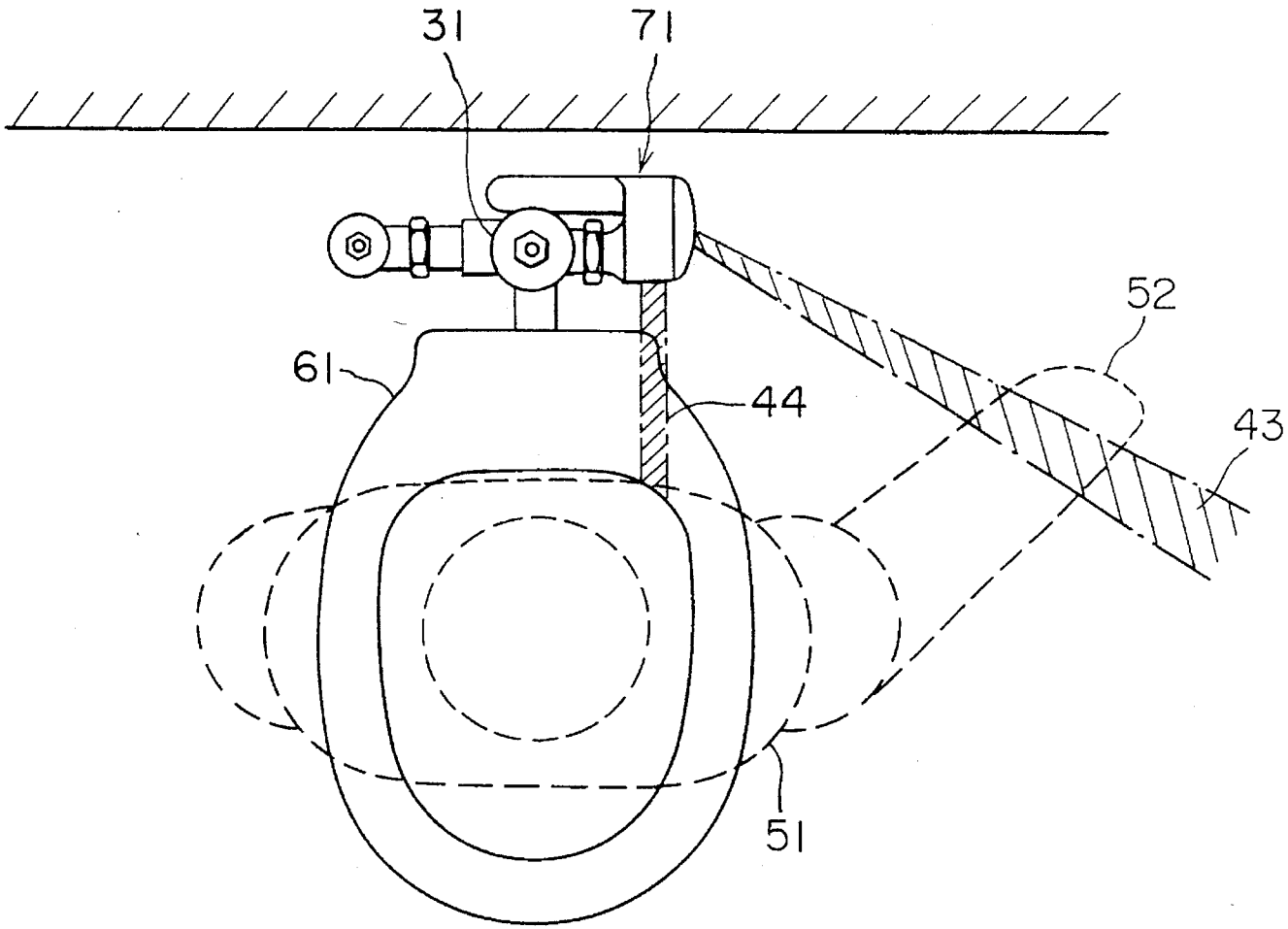
FIG. 7 is an explanatory top view showing the usage state where the automatic cleaning device is attached to an existing flush valve.

The state where user 51 operates the automatic flushing device according to the second embodiment which is attached to flush valve 31 is shown in FIG. 7. As second sensor section 42, sensor sections of any sensing system capable of detecting existence of hand, etc. of user 51 may be used. For example, a sensor adapted for emitting infrared rays to detect reflected light by user 51, or sensor adapted for detecting far infrared rays radiated from a hand, etc. of user 51 may be employed. In addition, a solar battery may be used to detect that rays of light are shielded by the hand, etc. of user 51.

When user 51 sitting on stool cover 61 and extends a hand 52 into sensing range 43, the existence of hand 52 is detected by such second sensor section 42. Thus, the user can intentionally easily carry out flushing even during use.

Figure 8:
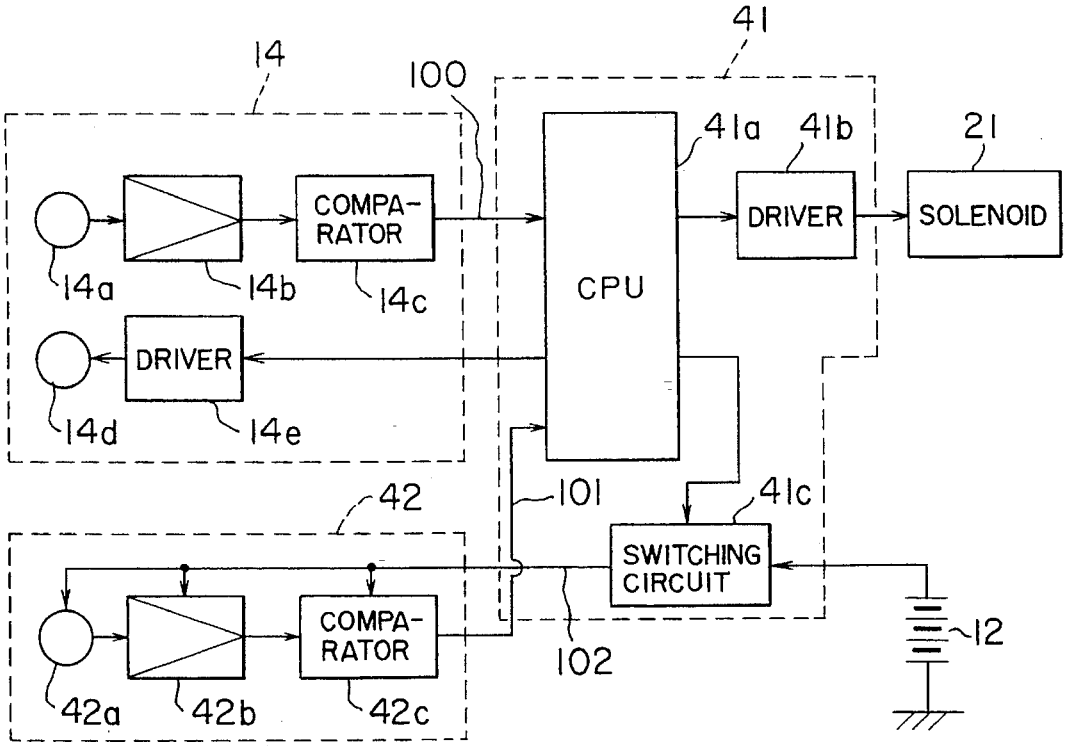
FIG. 8 is a block diagram showing circuit configuration of first and second sensor sections, signal processing circuit, solenoid and power supply in the automatic cleaning device.

The configuration of first sensor section 14, second sensor section 42, signal processing circuit 41, battery 12 and solenoid 21 in this embodiment is shown in FIG. 8. Since the configuration of first sensor section 14 is the same as sensor section 14 in the first embodiment, the same reference numerals are respectively attached to those components, and the repetitive explanation is omitted.

The second sensor section 42 includes a sensor 42*a* for detecting hand 52 of user 51, an amplifier 42*b* for amplifying a signal outputted from the sensor 42*a*, and a comparator 42*c* supplied with an amplified signal to compare it with a reference value to output a detection signal when that signal is above the reference value.

The signal processing circuit 41 includes a CPU 41*a*, a driver 41*b*, and a switching circuit 41*c*. The CPU 41*a* controls driver 14*e* of first sensor section 14 to output infrared rays from infrared LED 14*d* similarly to CPU 13*a* in the first embodiment. The infrared rays are reflected by user 51. As a result, CPU41*a* is supplied with detection signal 100 from comparator 14*c* to control driver 41*b*. In addition, CPU 41*a* is supplied with detection signal 101 from second sensor section 42 to carry out control of driver 41*b*. The switching circuit 41*c* switches delivery of power supply 12 to second sensor section 42.

Figure 9:
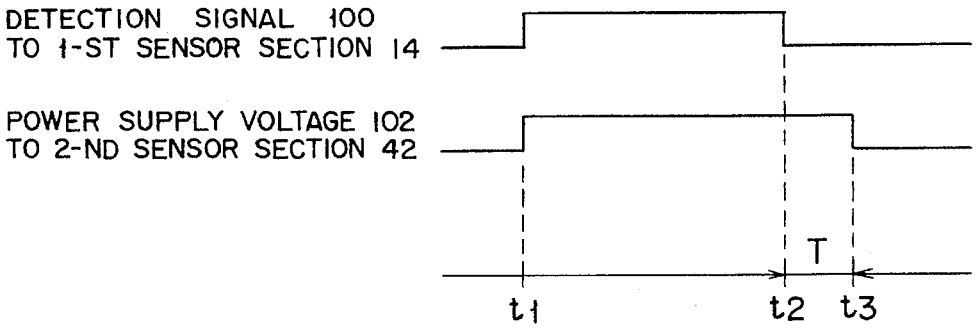
FIG. 9 is a time chart showing changes of detection signal outputted from the first sensor section and power supply voltage delivered to second sensor section in the automatic cleaning device.

The time chart of detection signal 100 outputted from first sensor section 14 and power supply voltage 102 to be delivered to second sensor section 42 is shown in FIG. 9. Energization to second sensor section 42 is carried out from the time point when approach of user 51 is detected for saving of power. From time point t1 when first sensor section 14 detects approach of user 51 to output detection signal 100, power supply voltage 102 is delivered to second sensor section 42. Also from time point t2 when user 51 is withdrawn and no detection signal 100 is outputted from first sensor section 14, a current is caused to flow in second sensor section 42 by time point t3 when a predetermined time T is passed. Thus, even after use, the user can intentionally carry out cleaning by swinging hand 52. In this case, the length of the predetermined time T may be, e.g., about 30 seconds.

The operation of the second embodiment thus constructed will now be described with reference to FIGS. 7 to 9. When user 51 becomes closer to stool 61, detection signal 100 is outputted from first sensor section 14, and is inputted to CPU 41*a* of signal processing circuit 41. Existence of user 51 is detected until a predetermined time is passed. When user 51 is away from stool 61 after use (time point t2), detection signal 100 is not outputted. At this time point t2, a drive signal is outputted from driver 41*b* by control of CPU 41*a*. As a result, a drive current flows in solenoid 21. As described above, cleaning water flows out.

On the other hand, when detection signal 100 is outputted from first sensor section 14 at time point t1, connection of switching circuit 41*c* is switched by control of CPU 41*a*, resulting in the state where power supply 12 is connected to sensor 42*a*, amplifier 42*b* and comparator 42*c*. When user 51 swings hand 52 at an arbitrary time from time point t1 to time point t3, detection signal 101 is outputted from second sensor section 42. When detection signal 101 is inputted to CPU 41*a*, driver 41*b* is controlled. As a result, a drive current is delivered to solenoid 21. Thus, flushing is carried out.

In this case, an approach may be employed to prohibit flushing by second sensor section 42 from being continuously carried out for a short time period. Namely, until a predetermined time is passed after hand 52 of user 51 is detected to carry out flushing, even if hand 52 is detected for a second time, flushing is not carried out, thereby making it possible to prevent waste of flushing water.

In accordance with the second embodiment, the following advantages can be provided in addition to the first embodiment. In the case of the prior art, when a user attempts to carry out flushing during use as described above, the user must stand up once or depress a push-button. This was inconvenient. Further, in the case where the second sensor of the remote control type is used, current flows in a sensor, etc. at all times, disadvantageously resulting in increased current consumption.

On the contrary, in this embodiment, flushing can be made with ease only by waving the hand during use. Further, user is not required to be in contact with a push-button, etc. This is sanitary. In addition, by causing a current to flow in second sensor section 41 and signal processing circuit 42 after existence of user is detected by first sensor section 14, power consumption can be reduced.

The above-mentioned embodiments are presented only for illustrative purpose, and do not limit this invention by any means. For example, the shape of the attachment means is not limited to shapes of case and cover shown. Namely, there may be employed attachment means in any shape which can accommodate respective elements such as sensor section and or signal processing circuit, etc. and can be attached to the handle unit portion of an existing flush valve.

What is claimed is:

1. An automatic flushing device comprising:

first sensor means for detecting presence of a human body in a first predetermined sensing range and withdrawal of the human body from the first predetermined sensing range;

second sensor means for outputting a detection signal when a portion of the human body exists within a second predetermined sensing range that is shorter than the first predetermined sensing range;

a signal processing circuit operative to output a drive signal when the first sensor means detects the withdrawal of the human body after more than a predetermined time elapses from the time point when the first sensor means detects the approach of the human body, or when the second sensor means outputs the detection signal;

an electromagnetic valve mechanism; and attachment means for attaching a unit of the first and second sensor means, the signal processing circuit and the electromagnetic valve mechanism to a flush valve, wherein the electromagnetic valve mechanism responds to the drive signal by operating the flush valve when the attachment means has attached the unit to the flush valve.

2. An automatic flushing device as set forth in claim 1, wherein the second predetermined sensing range of the second sensor means is such that the portion of the human body is a hand extended toward the unit.

* * * * *